US009111518B2

(12) United States Patent
Little et al.

(10) Patent No.: US 9,111,518 B2
(45) Date of Patent: Aug. 18, 2015

(54) MUSICAL SYSTEMS AND METHODS

(71) Applicant: Apple Inc., Cupertino, CA (US)

(72) Inventors: Alexander Harry Little, Woodside, CA (US); Eli T. Manjarrez, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/455,565

(22) Filed: Aug. 8, 2014

(65) Prior Publication Data

US 2015/0114209 A1 Apr. 30, 2015

Related U.S. Application Data

(63) Continuation of application No. 12/979,212, filed on Dec. 27, 2010, now Pat. No. 8,835,738.

(51) Int. Cl.
*G10H 1/38* (2006.01)
*G10H 7/00* (2006.01)

(52) U.S. Cl.
CPC ..... *G10H 1/38* (2013.01)

(58) Field of Classification Search
CPC ..... G10H 2220/096; G10H 2230/015; G10H 2220/241
USPC ..... 84/613, 634, 645
See application file for complete search history.

(56) References Cited

U.S. PATENT DOCUMENTS

| | | | | |
|---|---|---|---|---|
| 5,440,071 | A * | 8/1995 | Johnson | 84/637 |
| 5,852,252 | A * | 12/1998 | Takano | 84/650 |
| 6,111,179 | A * | 8/2000 | Miller | 84/442 |
| 6,188,008 | B1 * | 2/2001 | Fukata | 84/470 R |
| 6,898,729 | B2 * | 5/2005 | Virolainen et al. | 714/4.1 |
| 7,119,268 | B2 * | 10/2006 | Futamase et al. | 84/622 |
| 7,273,979 | B2 * | 9/2007 | Christensen | 84/615 |

(Continued)

FOREIGN PATENT DOCUMENTS

WO 2009/096762 A2 8/2009

OTHER PUBLICATIONS

Sugaya, Andrew, "The Chord Master," MIT OpenCourseWare, Massachusetts Institute of Technology, Cambridge, MA, Dec. 3, 2009 (Available online at http://ocw.mit.edu/courses/music-and-theater-arts/21m-380-music-and-technology-contemporary-history-and-aesthetics-fall-2009/projects/M IT21 M_ 380F09 proj_ssp_7. pdf, last visited Sep. 24, 2010).

(Continued)

*Primary Examiner* — Jeffrey Donels
(74) *Attorney, Agent, or Firm* — Kilpatrick Townsend & Stockton LLP

(57) ABSTRACT

Musical performance/input systems, methods, and products can accept user inputs via a user interface, generate, sound, store, and/or modify one or more musical tones. The user interface can present one or more regions corresponding to related chords. A set of related chords and/or a set of rhythmic patterns are generated based on a selected instrument and a selected style of music. The related chords can be modified via one or more effects units.

15 Claims, 4 Drawing Sheets

(56) References Cited

U.S. PATENT DOCUMENTS

| | | | | |
|---|---|---|---|---|
| 7,985,917 | B2 * | 7/2011 | Morris et al. | 84/637 |
| 8,426,716 | B2 * | 4/2013 | Little et al. | 84/613 |
| 8,539,368 | B2 * | 9/2013 | Nam et al. | 715/769 |
| 8,835,738 | B2 | 9/2014 | Little et al. | |
| 2004/0154460 | A1 * | 8/2004 | Virolainen et al. | 84/645 |
| 2004/0159219 | A1 * | 8/2004 | Holm et al. | 84/645 |
| 2007/0240559 | A1 * | 10/2007 | Hasebe | 84/637 |
| 2009/0091543 | A1 | 4/2009 | Camp, Jr. et al. | |
| 2011/0146477 | A1 * | 6/2011 | Tsukamoto | 84/485 R |
| 2011/0316793 | A1 * | 12/2011 | Fushiki | 345/173 |
| 2012/0160079 | A1 * | 6/2012 | Little et al. | 84/613 |

OTHER PUBLICATIONS

Kastani, Shinya, "PocketGuitar", Apple iTunes App Store, updated Dec. 20, 2008 (Available online at http:// itunes.apple.com/app/pocketguitar/id287965124?mt=8, last visited Jul. 19, 2010).

Non-Final Office Action mailed Oct. 7, 2013 for U.S. Appl. No. 12/979,212, 9 pages.

Notice of Allowance mailed on May 9, 2014 for U.S. Appl. No. 12/979,212, 5 pages.

* cited by examiner

MUSICAL SYSTEMS AND METHODS

RELATED APPLICATION

This application is a continuation of U.S. patent application Ser. No. 12/979,212 filed Dec. 27, 2010, the entire contents of which is incorporated herein by reference.

FIELD

The following relates to systems and methods for simulating playing of a virtual musical instrument.

BACKGROUND

Electronic systems for musical input or musical performance often fail to simulate accurately the experience of playing a real musical instrument. For example, by attempting to simulate the manner in which a user interacts with a piano keyboard, systems often require the user to position their fingers in the shapes of piano chords. Such requirements create many problems. First, not all users know how to form piano chords. Second, users who do know how to form piano chords find it difficult to perform the chords on the systems, because the systems lack tactile stimulus, which guides the user's hands on a real piano. For example, on a real piano a user can feel the cracks between the keys and the varying height of the keys, but on an electronic system, no such textures exist. These problems lead to frustration and make the systems less useful, less enjoyable, and less popular. Therefore, a need exists for a system that strikes a balance between simulating a traditional musical instrument and providing an optimized user interface that allows effective musical input and performance.

SUMMARY

Various embodiments provide systems, methods, and products for musical performance and/or musical input that solve or mitigate many of the problems of prior art systems. A user interface can present one or more regions corresponding to related notes and/or chords. A user can interact with the regions in various ways to sound the notes and/or chords. Other user interactions can modify or mute the notes or chords. A set of related chords and/or a set of rhythmic patterns can be generated based on a selected instrument and a selected style of music. The chords can be related according to various musical theories. For example, the chords can be diatonic chords for a particular key. Some embodiments also allow a plurality of systems to communicatively couple and synchronize. These embodiments allow a plurality of users to input and/or perform music together.

BRIEF DESCRIPTION OF THE DRAWINGS

In order to further explain/describe various aspects, examples, and inventive embodiments, the following figures are provided.

Figure 1:
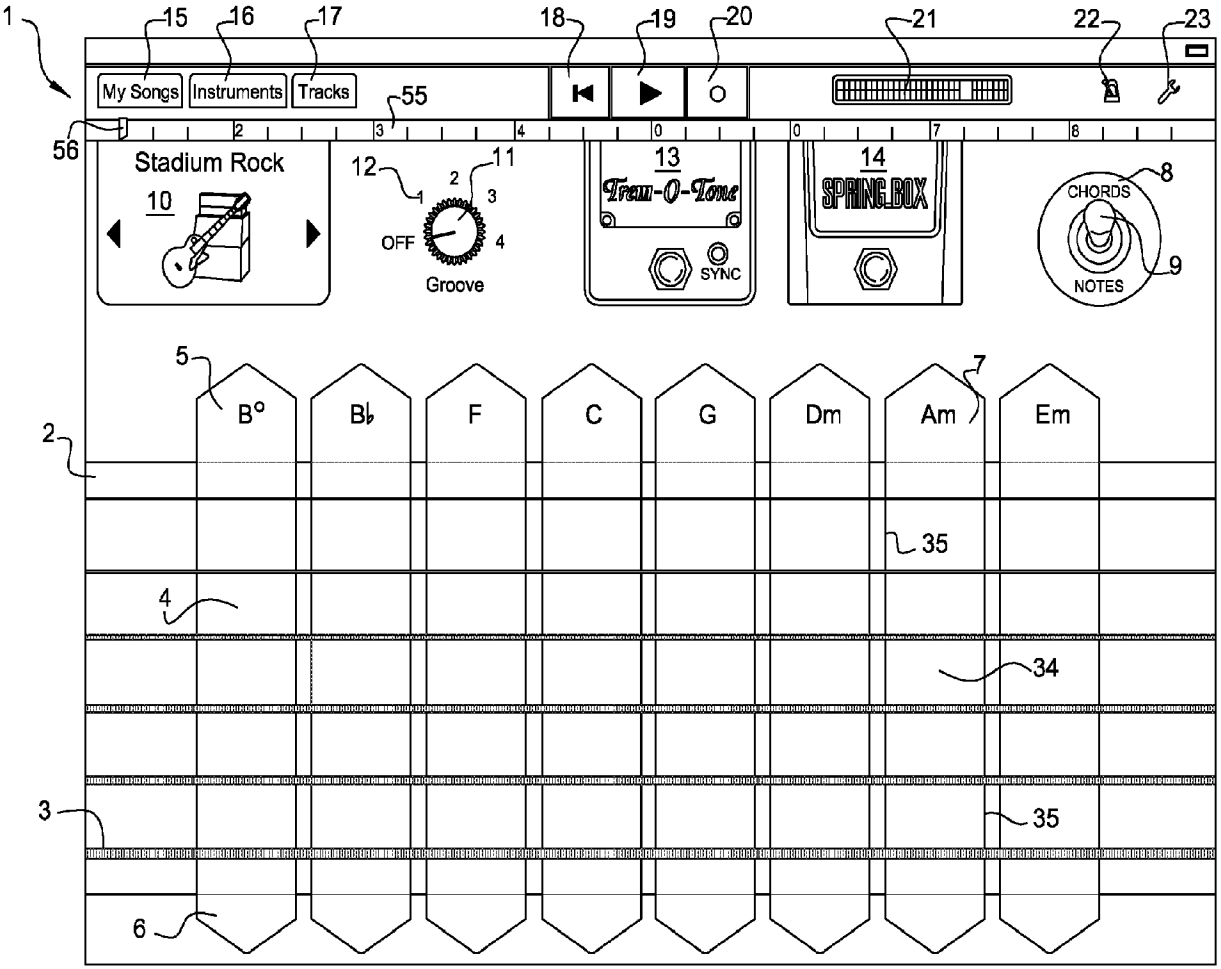
FIG. 1 depicts a schematic illustration of a chord view.

It should be understood that the various embodiments are not limited to the arrangements and instrumentality shown in the drawings.

DETAILED DESCRIPTION

The functions described as being performed at various components can be performed at other components, and the various components can be combined and/or separated. Other modifications can also be made.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure. Numerical ranges include all values within the range. For example, a range of from 1 to 10 supports, discloses, and includes the range of from 5 to 9. Similarly, a range of at least 10 supports, discloses, and includes the range of at least 15.

The following disclosure describes systems, methods, and products for musical performance and/or input. Various embodiments can include or communicatively couple with a wireless touchscreen device. A wireless touchscreen device including a processor can implement the methods of various embodiments. Many other examples and other characteristics will become apparent from the following description.

A musical performance system can accept user inputs and audibly sound one or more tones. User inputs can be accepted via a user interface. A musical performance system, therefore, bears similarities to a musical instrument. However, unlike most musical instruments, a musical performance system is not limited to one set of tones. For example, a classical guitar or a classical piano can sound only one set of tones, because a musician's interaction with the physical characteristics of the instrument produces the tones. On the other hand, a musical performance system can allow a user to modify one or more tones in a set of tones or to switch between multiple sets of tones. A musical performance system can allow a user to modify one or more tones in a set of tones by employing one or more effects units. A musical performance system can allow a user to switch between multiple sets of tones. Each set of tones can be associated with a channel strip (CST) file.

A CST file can be associated with a particular track. A CST file can contain one or more effects plugins, one or more settings, and/or one or more instrument plugins. The CST file can include a variety of effects. Types of effects include: reverb, delay, distortion, compressors, pitch-shifting, phaser, modulations, envelope filters, equalizers. Each effect can include various settings. Some embodiments provide a mechanism for mapping two stompbox bypass controls in the channel strip (.cst) file to the interface. Stompbox bypass controls will be described in greater detail hereinafter. The CST file can include a variety of settings. For example, the settings can include volume and pan. The CST file can include a variety of instrument plugins. An instrument plugin can generate one or more sounds. For example, an instrument plugin can be a sampler, providing recordings of any number of musical instruments, such as recordings of a guitar, a piano, and/or a tuba. Therefore, the CST file can be a data object capable of generating one or more effects and/or one or more sounds. The CST file can include a sound generator, an effects generator, and/or one or more settings.

A musical performance method can include accepting user inputs via a user interface, audibly sounding one or more tones, accepting a user request to modify one or more tones in a set of tones, and/or accepting a user request to switch between multiple sets of tones.

A musical performance product can include a computer-readable medium and a computer-readable code stored on the computer-readable medium for causing a computer to perform a method that includes accepting user inputs, audibly sounding one or more tones, accepting a user request to modify one or more tones in a set of tones, and/or accepting a user request to switch between multiple sets of tones.

A non-transitory computer readable medium for musical performance can include a computer-readable code stored thereon for causing a computer to perform a method that includes accepting user inputs, audibly sounding one or more tones, accepting a user request to modify one or more tones in a set of tones, and/or accepting a user request to switch between multiple sets of tones.

A musical input system can accept user inputs and translate the inputs into a form that can be stored, recorded, or otherwise saved. User inputs can include elements of a performance and/or selections on one or more effects units. A performance can include the playing of one or more notes simultaneously or in sequence. A performance can also include the duration of one or more played notes, the timing between a plurality of played notes, changes in the volume of one or more played notes, and/or changes in the pitch of one or more played notes, such as bending or sliding.

A musical input system can include or can communicatively couple with a recording system, a playback system, and/or an editing system. A recording system can store, record, or otherwise save user inputs. A playback system can play, read, translate, or decode live user inputs and/or stored, recorded, or saved user inputs. When the playback system audibly sounds one or more live user inputs, it functions effectively as a musical performance device, as previously described. A playback system can communicate with one or more audio output devices, such as speakers, to sound a live or saved input from the musical input system. An editing system can manipulate, rearrange, enhance, or otherwise edit the stored, recorded, or saved inputs.

Again, the recording system, the playback system, and/or the editing system can be separate from or incorporated into the musical input system. For example, a musical input device can include electronic components and/or software as the playback system and/or the editing system. A musical input device can also communicatively couple to an external playback system and/or editing system, for example, a personal computer equipped with playback and/or editing software. Communicative coupling can occur wirelessly or via a wire, such as a USB cable.

A musical input method can include accepting user inputs, translating user inputs into a form that can be stored, recorded, or otherwise saved, storing, recording, or otherwise saving user inputs, playing, reading, translating, or decoding accepted user inputs and/or stored, recorded, or saved user inputs, and manipulating, rearranging, enhancing, or otherwise editing stored, recorded, or saved inputs.

A musical input product can include a computer-readable medium and a computer-readable code stored on the computer-readable medium for causing a computer to perform a method that includes accepting user inputs, translating user inputs into a form that can be stored, recorded, or otherwise saved, storing, recording, or otherwise saving user inputs, playing, reading, translating, or decoding accepted user inputs and/or stored, recorded, or saved user inputs, and manipulating, rearranging, enhancing, or otherwise editing stored, recorded, or saved inputs.

A non-transitory computer readable medium for musical input can include a computer-readable code stored thereon for causing a computer to perform a method that includes accepting user inputs, translating user inputs into a form that can be stored, recorded, or otherwise saved, storing, recording, or otherwise saving user inputs, playing, reading, translating, or decoding accepted user inputs and/or stored, recorded, or saved user inputs, and manipulating, rearranging, enhancing, or otherwise editing stored, recorded, or saved inputs.

Accepting user inputs is important for musical performance and for musical input. User inputs can specify which note or notes the user desires to perform or to input. User inputs can also determine the configuration of one or more features relevant to musical performance and/or musical input. User inputs can be accepted by one or more user interface configurations.

Musical performance system embodiments and/or musical input system embodiments can accept user inputs. Systems can provide one or more user interface configurations to accept one or more user inputs.

Musical performance method embodiments and/or musical input method embodiments can include accepting user inputs. Methods can include providing one or more user interface configurations to accept one or more user inputs.

Musical performance product embodiments and/or musical input product embodiments can include a computer-readable medium and a computer-readable code stored on the computer-readable medium for causing a computer to perform a method that includes accepting user inputs. The method can also include providing one or more user interface configurations to accept one or more user inputs.

A non-transitory computer readable medium for musical performance and/or musical input can include a computer-readable code stored thereon for causing a computer to perform a method that includes accepting user inputs. The method can also include providing one or more user interface configurations to accept one or more user inputs.

The one or more user interface configurations, described with regard to system, method, product, and non-transitory computer-readable medium embodiments, can include a chord view and a notes view.

FIG. 1 shows a schematic illustration of a chord view 1. The chord view 1 includes a fretboard 2, and one or more strings 3. One or more swipe regions 4 span the fretboard 2 and/or the one or more strings 3. One or more of the swipe regions 4 terminate with a down-strum region 6 and/or an up-strum region 5. A predefined chord is assigned to each swipe region 4. One or more predefined chord labels 7 are positioned in or near each swipe region 4.

The chord view 1 allows a user to strum or arpeggiate across the user interface triggering the notes of a chord. The chord view 1 can include any number of swipe regions 4, for example, from 1 to 16 swipe regions or from 4 to 8 swipe regions. Each swipe region 4 is associated with a pre-defined chord voiced appropriately for a selected rig or configuration. Selection of rigs is discussed in, greater detail later with respect to rig browser 10. Each rig or configuration can incorporate and assign a voicing for each of one or more strings. For example, a rig can incorporate 6 guitar strings.

The chords assigned to each swipe region 4 can be small MIDI files. MIDI (Musical Instrument Digital Interface) is an industry-standard protocol defined in 1982 that enables electronic musical instruments such as keyboard controllers, computers, and other electronic equipment to communicate, control, and synchronize with each other. Touching any string 3 inside a swipe region 4 plays the note that is assigned to that string within the chord MIDI file. Swiping across the strings within a swipe region 4 can play the note of the chord assigned to the string 3 as the finger crosses it. In one example, the chord is played based on an initial location the finger touches first for the swipe so that swiping diagonally will not cause notes or chords from other adjacent swipe regions 4 to be played.

The region of the user interface where the swipe regions 4 overlap the fretboard 2 can be referred to as the chord strummer area. The area of the user interface where swipe regions 4 do not overlap the fretboard 2 can be referred to as the button strummer area or the button strummer areas. In some embodiments, the chord strummer area can continue to function when a user interacts with the button strummer area.

As mentioned above, the button strummer area can include an up-strum region 5 and a down-strum region 6 for each swipe region 4. Each of the up-strum regions 5 and the down-strum regions 6 can be referred to as buttons. Therefore, an embodiment with 8 swipe regions 4, could include 16 buttons (two per chord). The buttons, i.e., the down-strum regions 6 and/or the up-strum regions 5, can perform "one-shot" strums. A "one-shot" strum plays a sound that can be equivalent to the user swiping a finger across all strings 3 in a swipe region 4. Tapping down-strum region 6 can be equivalent to sequentially sounding the strings 3 from the bottom of the fretboard 2 to the top of the fretboard 2. Tapping up-strum region 5 can be equivalent to sequentially sounding the strings 3 from the top of the fretboard 2 to the bottom of the fretboard 2. The "one-shot" strums can be separate MIDI files or can sequentially sound the MIDI file for each string 3. For example, a button strum file can be anon-tempo referenced MIDI file. Each configuration can have its own set of button strum MIDI files.

In addition to having one or more button strum locations for two different strum styles, each swipe region 4 can have an open chord region 34 and one or more muted chord regions 35. In one example, the one or more muted chord regions 35 are located on the boundary of the swipe region 4, for example, to the far left or far right of the swipe region 4. Touching or swiping the open chord region 34 of the swipe region 4 can sound an un-muted, open chord. Touching or swiping anywhere in a muted chord region 35 can change the triggered voice to a muted sound rather than an open sound. Touching in a muted chord region 35 while an un-muted voice is ringing can stop the sound as if the player had laid their hand on the strings of a guitar. The mute state can apply to the entire generator voice, as opposed to note-by-note. The muted state can override any open strings voices from any chord strum, button strum or groove.

In example, strum muting is mapped to a MOD wheel (diminutive for Modulation Wheel). A MOD wheel is a controller, which can be used to add expression or to modulate various elements of a synthesized sound or sample. In order to create such effects, the mod wheel can send continuous controller messages (CC), indicating the magnitude of one or more effects applied to the synthesized sound or sample. In the case of strum muting, the MOD wheel can send continuous controller messages indicating the volume of a synthesized sound or sample.

In one example, to more effectively emulate the experience of playing a real string instrument, like a guitar, when the user places the side of their hand across the strings, the sound is muted or stopped. Therefore, in some embodiments, strumming a chord and then subsequently touching multiple strings 3 simultaneously stops or mutes the sound generated from the strum.

Figure 2:
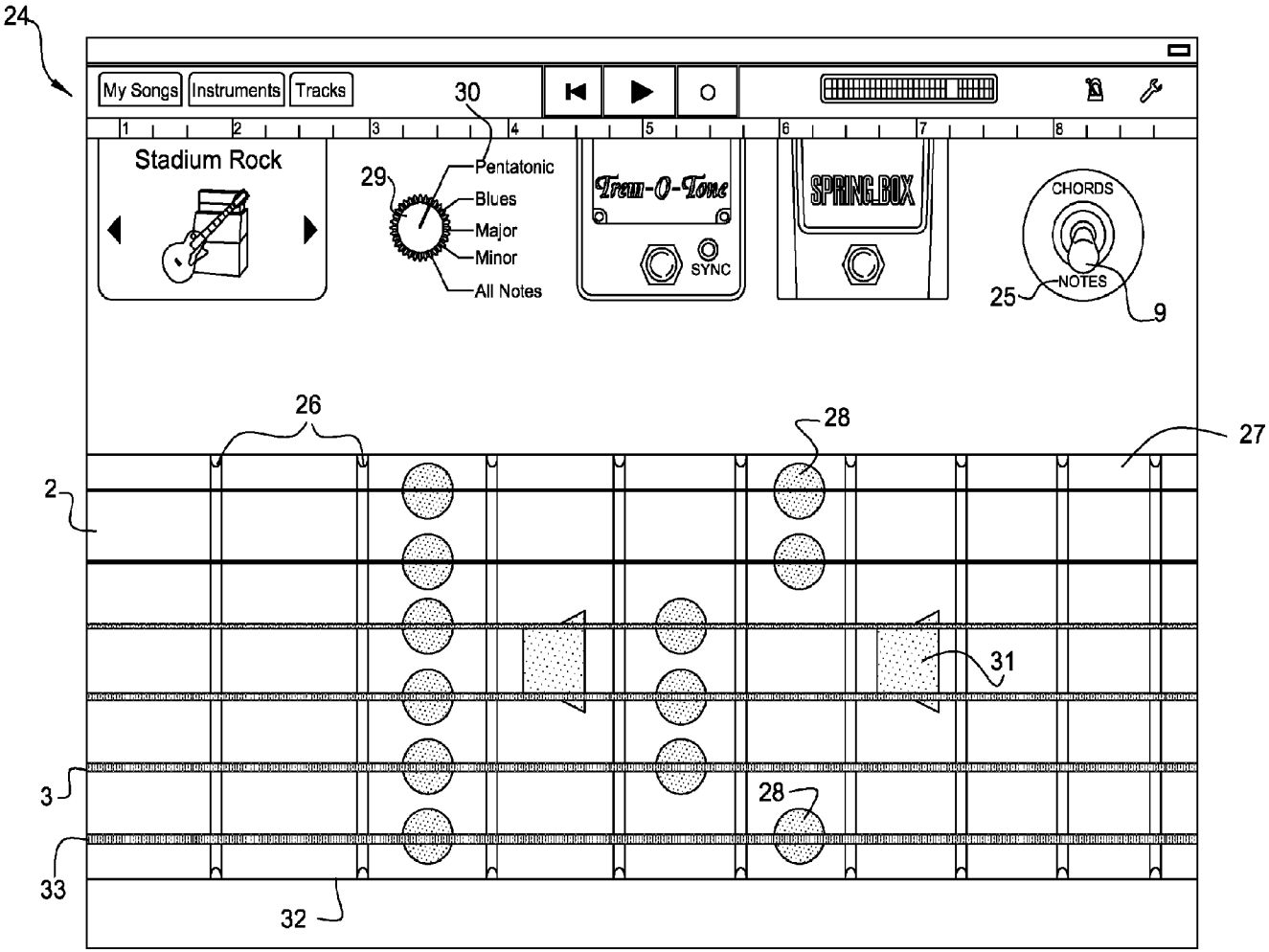
FIG. 2 depicts a schematic illustration of a notes view.

The chord view 1 includes a toggle 9 to switch between a chord mode 8, as illustrated in FIG. 1, and a note mode 25, as illustrated in FIG. 2. Turning to FIG. 2, a schematic illustration of a notes view 24 is shown. Notes view 24 can include any or all of the features of chord view 1. Notes view 24 includes the fretboard 2, the one or more strings 3, and one or more fretbars 26. The fretbars 26 extend across the fretboard 2 in a direction perpendicular to the one or more strings 3. Notes view 24 can include any number of fretbars 26, for example 9 fretbars, thereby providing an illustration of 9 frets of a guitar fretboard.

Tapping on any string 3 between adjacent fretbars 26 or between a fretbar 26 and a boundary of notes view 24 can play or input a single note. In one example, the note can is played from a guitar channel strip (.CST) file.

As shown, the fretboard 2 remains a consistent graphic. The fretbars 26, however, can shift to the left and to the right to indicate shifting up and down a guitar fretboard. One or more fret markers 31 and a headstock (not shown) can also adjust to reflect the layout for any key. When the fretboard adjusts to a project key, the notes automatically depending on the project key. For a given key, the fretboard can automatically adjust to a project key so that the tonic note of the key is always on the $3^{rd}$ fret 32 of the $6^{th}$ string 33. The $3^{rd}$ fret 32 can correspond to the space 27 between the second and third fretbars 26, when the fretbars are counted from left to right across fretboard 2. The $6^{th}$ string 33 can correspond to the string 3 closest to the bottom of notes view 24.

Notes view 24 also includes a scale selector 29 having a plurality of scale selections 30. The scale selections 30 represent one or more scales. For example, the scale selections can include a Major scale section, a Minor scale selection, a Blues scale selection, and/or a Pentatonic scale selection. The scale selections 30 can also include an All Notes selection, indicating that no particular type of scale has been selected. In one example, when a scale selection is made using scale selector 29, a scale overlay is displayed on the fretboard 2. The scale overlay can include one or more position indicators 28. The one or more position indicators can appear in a space 27 between two adjacent fretbars 26, or in a space 27 between a fretbar 26 and an edge or boundary of notes view 24. The position indicators 28 show a user where to place their fingers on the fretboard 2 to play the notes of the scale selection 30.

In some embodiments, one or more scale overlays are hard-coded into the application, because they are not rig dependent and remain consistent across all rigs. In other embodiments, different scales can be available for different rigs. A default scale can be established based on a rig and/or the quality (major/minor) of the project key. For instance, for a certain rig, minor keys may default the scale to minor pentatonic, where major keys may default to major pentatonic. In some embodiments, the scale overlays do not need to read the project key, because the locations of the scale degrees in the note player remain consistent regardless of project key.

A scale grid player is also shown. The Scale Grid player can limit the notes that can be played in Notes view 24 to only the notes within a selected scale. In one example, the user is presented with a set of pre-selected or pre-programmed scales. In one example, different scales are presented depending on the chosen rig and the key of the project. The scale grid player lets the user interact with virtual guitar strings, but also can prevent them from playing "wrong" notes that are out of the scale. All of the articulations that work in the standard Notes view 24 can work in the Scale Grid player such as hammer-ons, pull-offs, slides, bends and vibrato. The Scale Grid player interface can have 6 strings oriented as seen in the other interface images, i.e. Chord View 1 and Notes View 24.

Position indicators 28 can be provided that show where the correct notes are located on the fretboard 2. In one example, incorrect notes can simply be muted, such that they do not sound when touched by the user. Alternatively, incorrect notes can be entirely eliminated from the display, such that only position indicators 28 that correspond to correct notes are displayed. Therefore, in comparison to the Notes View 24, the scale grid view can eliminate all notes that are not position indicators 28.

Referring to FIG. 1, chord view 1 includes a first stompbox 13 and second stompbox 14. Notes view 24 also includes one or more stompboxes. When a user activates one or more stompboxes 13, 14, the tones of the chords and/or notes played can be modified. The one or more stompboxes can, therefore, provide one or more user interface configurations to accept a user request to modify one or more tones in a set of tones and/or various methods to modify one or more tones. The stompboxes 13, 14 can include a bypass control that is part of the CST (channel strip) file. The stompboxes 13, 14 can operate as toggle switches. For example, when the user activates by tapping the stompbox 13, the effect controlled by the stompbox 13 is activated. When the user taps or interacts with stompbox 13 again, the effect is deactivated.

Referring to FIG. 1, chord view 1 includes a groove selector 11, having one or more groove settings 12, for example five or more groove settings 12. Notes view 24 can also include one or more groove selectors. In one example, each groove setting is linked to a musical pattern, such as a MIDI file.

In one example as a default, the groove selector 11 is set to an "off" groove setting 12. In the off state, the swipe region 4 and the button strum regions 5 and 6 can function as previously described. When a grove setting 12 is selected, a tempo-locked, i.e., fixed tempo, guitar part and/or a tempo-locked strumming rhythm can play when the user touches anywhere inside a swipe area 4 and/or on any string 3. In some embodiments, touching the swipe area 4 and/or any string 3 one or more times will not re-trigger the beginning of the groove, but functions as momentary "solo" state for the sequence. A momentary solo state can pause playback of the selected groove and sound the chord or note being played. Once the user stops touching the swipe area 4 and/or any string 3, the groove can resume playing.

In addition to or as an alternative to groove selector 11, multi-touch user inputs can be detected and used to switch between grooves. For example, when a user swipes in a particular direction with a particular number of fingers, a particular groove selection can be made. In one example, if a touch-sensitive input detects a swipe with one finger a first groove is selected. If the touch-sensitive input detects a swipe with two fingers, a second groove is selected. If the touch-sensitive input detects a swipe with three fingers, a third groove is selected. If the touch-sensitive input detects a swipe with four fingers, a fourth groove is selected.

The guitar part and/or the strumming rhythm can be a MIDI file or a MIDI sequence for the selected chord. The MIDI file can be any number of measures long, for example from 1 to 24 measures, or from 4 to 8 measures. The MIDI file or sequence can loop continuously while the groove setting 12 is selected on the groove selector 11.

In some embodiments, the groove does not latch, in other words, the groove will only sound while the user continues to touch the swipe region 4 and/or the string 3. The groove can mute when the user releases the touch and start playing when the user touches again. Therefore, the groove can be a momentary switch, instead of a latch state. In other embodiments, the groove can also be a latch state. In latch state embodiments, playback of the groove begins when the user taps a swipe region 4 and/or a string 3 and continues even when the user is no longer touching the swipe region 4 and/or the string 3. The user can then stop the groove by modifying the groove selector 11 and/or by tapping the swipe region 4 and/or the string 3 again.

The chord view 1 can also include a transport strip 55 and a transport 56, as illustrated in FIG. 1. Notes view 24 can also include a transport strip 55 and a transport 56. The transport strip 55 can indicate the duration of a song, a recording, and/or a groove. The transport 56 can indicate the current playback position within the duration of the song, recording, and/or groove. When the transport 56 is stopped, playback of a song, recording, and/or groove can begin as soon as a swipe region 4 and/or a string 3 is touched.

In chord view 1, subsequent touches of strings 3 and/or swipe regions 4 can trigger sequences of chords and/or notes that will remain quantized to the playback of the song, recording, and/or groove. In one example, quantization is implemented to allow a note or chord to change only on an eighth note or on a quarter note. Touching a new swipe region or string can cause a song, recording, and/or groove to start over from the beginning, but more preferably playback of the song, recording, and/or groove continues, uninterrupted and only the chord or note changes.

The playback of a song, recording, and/or groove can be stopped (reset) when the user switches to the notes view 24 or upon receiving other predefined user input. In one example, playback is not stopped or reset when a different song, recording, and/or groove is selected. This allows the user to adjust the Groove Selector Knob 11 in real time, synchronized to the project tempo.

Playback of a groove can begin or continue regardless of whether a recording, track, or song is currently playing. The user can set a tempo and/or a key to which the groove can correspond. Setting a tempo and/or a key can be useful when no recording, track, or song is playing. When a recording, track, or song is playing or being recorded, the groove can correspond to the tempo and key thereof. A default tempo and/or key can be employed. For example, a default can be set at 120 beats per minute (bpm) in the key of C major.

Referring to FIG. 1, chord view 1 can include additional features. Notes view 24 can include any or all of these additional features as well. For example, chord view 1 and/or note view 24 can include navigational features, such as a songs selector 15, an instruments selector 16, and a tracks selector 17. The songs selector 15 can allow a user to access saved songs and/or musical performances. For example, a user can access recorded performances or songs stored in a music library. The instruments selector 16 can allow a user to select a particular instrument. When an instrument is selected, the user interface can be updated to indicate the change and the notes and chords sounded upon user interaction with the chord view 1 or the notes view 24 can change to correspond to the selected instrument. The tracks selector 17 can allow a user to select a pre-defined musical track. The user can then play along to the pre-defined musical track. If the user records the performance, the pre-defined musical track can become part of the new recording. Chord view 1 and/or note view 24 can include playback, volume, and recording features, such as a back button 18, a play button 19, a record button 20, and a volume slider 21. The record button 20 can allow a user to record a musical performance or a musical input. The play button 19 can allow a user to playback a stored musical performance or input. The volume slider 21 can allow a user to adjust the playback volume. The back button 18 can allow a user to return to the beginning of a track and/or to skip back a predetermined interval in a track. Chord view 1 and/or note view 24 can also include a metronome button 22 and a settings button 23. The metronome button 22 can activate a metronome that produces an audible sound in a predefined rhythm or tempo. The settings button 23 can allow a user to access additional features and/or to configure the user interface.

Some embodiments provide one or more user interface configurations to switch between multiple sets of tones and/or various methods to switch between multiple sets of tones. Referring to FIG. 1, chord view 1 can include a rig browser 10, having one or more rig settings. Notes view 24 can also include one or more rig browsers or configuration browsers.

As discussed above, a user can select an instrument sound using instruments selector 16. The instrument can be any instrument, for example a string instrument, such as an acoustic guitar, a distorted rock guitar, a clean jazz guitar, etc. When an instrument is selected using the instruments selector 16, and a rig is selected using rig browser 10, a corresponding Auto Player File (APF) can be loaded. An Auto Player File can include one or more channel strip (.cst) files, one or more stompbox bypass maps, one or more sets of chords, one or more sets of strums, one or more sets of grooves can be loaded, and/or one or more sets of graphical assets.

Each Auto Player File can include one or more channel strip (.cst) files. For example, a rig can include from 1 to 20, or from 5 to 10 channel strip files. Each channel strip (.cst) file can define the basic sound generator and/or the effects that can shape the sound.

The basic sound generator can be either sampled or modeled. The basic sound generator can include sounds and/or samples spanning a range of tones. For example, the basic sound generator can provide sounds and/or samples that allow the selected instrument to correlate from a Low E ($6^{th}$) string, to an A on the $17^{th}$ fret of the high E ($1^{st}$) string. The basic sound generator can also include sounds and/or samples for a variety of musical performance styles, such as un-muted pluck attack, muted pluck attack, un-muted hammer attack, muted hammer attack, and various string and fret noise effects.

In one example, each string on a traditional guitar includes its own independent sound generator. This allows a user to play a chord, such as an E chord, and then pitch bend one note of the E chord, without affecting playback of the other notes of the chord. In a further example, a user can input a hammer-on by inputting and holding a note on a chosen string and then rapidly tapping on a position closer to a bridge of the guitar. In this further example, if multiple inputs are detected on the chosen string the system outputs a sound correspond to the input closest to the bridge of the guitar.

Each Auto Player File can include one or more MIDI files that define chord voicings for the rig. A chord voicing can define the instrumentation, spacing, and ordering of the pitches in a chord. Rigs can share the same chord voicings. In some embodiments, different chord voicings can be provided depending on the instrument and/or rig. For example, an acoustic guitar rig may use open chord voicings, whereas a rock guitar rig may use barre chord voicings. In some embodiments, the Auto Player File contains all the required chord voicings, since the MIDI files that define the chord voicings are relatively small, i.e., require a minimum of memory.

A musical key identifies a tonic triad, which can represent the final point of rest for a piece, or the focal point of a section. For example, the phrase in the key of C means that C is the harmonic center or tonic. A key may be major or minor. In one embodiment, an Auto Player File for a single rig can contain 192 Chord MIDI Files (8 chords×12 keys×2 qualities Maj/min).

The Chord MIDI files can be created according to an authoring method. The authoring method can include creating a chord file for each of one or more chords in each of one or more qualities. For example, 16 chord files can be created for 8 chords×2 qualities (Major and minor). The chords can be created for a particular instrument, such as a six-string guitar. If the chords are created for a six-string guitar, the chords can be authored as 6-string chords. In music, the root of a chord is the note or pitch upon which such a chord is built or hierarchically centered. According to some embodiments, the root can be on the $6^{th}$ string, but the root is not required to be on the $6^{th}$ string. The root can be on any string. The authoring method can also include extrapolating the chord files for each of one or more keys to create a chord file set for a rig. For example, the 16 chord files can be extrapolated and/or transposed for each of 0.12 keys to a chord file set for a rig. The step of extrapolating the chord files can be done manually or programmatically, for example by employing a script. The authoring method can also include altering or re-voicing the generated chords on a case-by-case basis to make sure they are authentic sounding for the key and rig.

Each Auto Player File can include one or more "one-shot" style MIDI files. A "shot-shot" style MIDI file plays an entire sequence once an input is received, even if the input ceases prior to completion of playing the sequence. When each swipe region 4 includes both an up-strum region 5 and a down-strum region 6, two button strum files per chord can be provided for each rig. Each button strum file can be associated with a button strum region 5, 6. Unique button strum files can also be associated with one or more muted chord regions 35. For example, one or more muted strum button strum files can be provided in addition to one or more open strum button strum files. Additionally, unique button strum files can be provided for various chord voicings, such as power chords, full chords, high-voice, and low-voice. Some embodiments include a set of typical button strum files, including pairs like an up-strum/down-strum, muted strum/open strum, slow strum/fast strum, power chord/full chord, and high voice/low voice.

The Button strum MIDI files can be created according to a button strum authoring method. The authoring method can include creating a button strum file for each of one or more buttons, i.e., up-strum region 5, down-strum region 6, and/or muted chord region 35, for each of one or more keys, for each of one or more chords, and/or for each of one or more qualities, i.e., Major and/or Minor. For example, each rig can include 384 button strum files (2 buttons×8 chords×12 keys×2 qualities Maj/min). Instead of creating a button strum file for each of one or more keys, the authoring method can include creating a button strum file for each of one or more buttons, for each of one or more chords, and/or for each of one or more qualities. Subsequently, the method can include transposing and/or extrapolating each of the button strum files for each of one or more keys. In some embodiments, the same transposition and/or extrapolation script can be used as mentioned above for the Chord MIDI files to generate the transposed files from an initial authored set of 32 Button Strum Files.

In some embodiments, button strum performance is similar to the mute sample selection. For example, if the button strum file was authored in a mute state, touching the mute zone will not change the playback voice of the strum, if the button strum file was authored using an open voice, touching the mute zone will switch the voice to a muted voice.

In one example, each Auto Player File can include one or more sets of groove MIDI files that are four measure tempo referenced rhythmic MIDI patterns. Each rig can have 1 to 20, or 5 to 10 groove styles or MIDI files. A groove MIDI file authoring method can include creating a groove MIDI file for each of one or more groove styles, for each of one or more chords, for each of one or more keys, and for each of one or more qualities. For example, each Auto Player File can include 960 Groove MIDI files (5 groove styles×8 chords×12 keys×2 qualities Maj/min). Alternatively, the groove MIDI file authoring method can include creating a groove MIDI file for of one or more groove styles, for each of one or more keys, and for each of one or more qualities, and subsequently extrapolating and/or transposing the chord files for each of one or more keys to create a chord file set for a rig. Therefore, in the example above, 80 Groove MIDI files (5 groove styles×8 chords×2 qualities Maj/min can be created and can then be extrapolated and/or transposed to each of the 12 keys to create the 960 Groove MIDI files. In some embodiments, the same extrapolation and/or transposition script for extrapolating and/or transposing the Chord MIDI files can be used for the groove MIDI file authoring method.

Each Auto Player File can include one or more graphical assets. The one or more graphical assets can include one or more skins, one or more string images, one or more stompbox images, one or more switch images, one or more knob images, one or more inlay images, and/or one or more headstock images. A skin can provide an image defining the overall style of a user interface, such as chord view 1, as illustrated in FIG. 1, or notes view 24, as illustrated in FIG. 2. A string image can provide a graphical depiction of a string, such as string 3, as illustrated in FIGS. 1 and 2. A stompbox image can provide a graphical depiction of a stompbox, such as first stompbox 13 or second stompbox 14, as illustrated in FIGS. 1 and 2. A switch image can provide a graphical depiction of a switch, such as chords/notes switch 9, as illustrated in FIGS. 1 and 2. A knob image can provide a graphical depiction of a knob, such as groove selector 11, as illustrated in FIG. 1, or scale selector 29, as illustrated in FIG. 2. An inlay image can provide a graphical depiction of a fretboard inlay, such as fretboard 2, as illustrated in FIGS. 1 and 2. An inlay image can also provide a graphical depiction of one or more fret markers, such as fret markers 31, as illustrated in FIG. 2. A headstock image can provide a graphical depiction of an instrument headstock.

Table 1 provides a summary of the files that can be provided in an Auto Play File of an exemplary rig.

TABLE 1

| Item | Number | Comment |
|---|---|---|
| EXS Instrument | 1 | May be used for multiple rigs. Mono, open, and palm muted voices. |
| CST | 1 | Using Pedal Board and Amp Designer |
| Chord Files | 192 (24 chord database files) | 8 chords × 12 keys × 2 qualities (maj/min) = 192 |
| Button Strum Files | 384 | 2 buttons × 8 chords × 12 keys × 2 qualities (maj/min) = 384 |
| Groove Files | 960 | 5 grooves × 8 chords × 12 keys × 2 qualities (maj/min) |
| Graphic Skins | 1 set | Body, neck, headstock, inlays, strings, stompboxes, switch, knob |

The chords for each rig can be selected based on standard music theory. For example, 7 diatonic chords can be chosen from a key. These 7 diatonic chords are the 7 standard chords that can be built using only the notes of the scale associated with the selected key. In some embodiments, another useful chord that is not in the diatonic key can also be included.

Table 2 summarizes chords that can be chosen for a major key. In a major key the following chords could be chosen: Tonic major chord (I), Supertonic minor chord (ii), Mediant minor chord (iii), Subdominant major chord (IV), Dominant major chord (V), Submediant minor chord (vi), Leading Tone diminished chord (vii'), and the one non-diatonic chord—the Subtonic major chord (bVII). In the key of C Major, therefore, the following chords would be selected: C Major (I), D minor (ii), E minor (iii), F Major (IV), G Major (V), A minor (vi), B diminished (vii'), B-flat Major (bVII). In the key of D Major, the following chords would be selected: D Major (I), E minor (ii), F-sharp minor (iii), G Major (IV), A Major (V), B minor (vi), C-sharp diminished (vii'), C Major (bVII).

TABLE 2

| Key | Tonic I Major | Supertonic II Minor | Mediant III Minor | Subdominant IV Major | Dominant V Major | Submediant vI Minor | Leading Tone vII* Diminished | Subtonic ♭VII Major |
|---|---|---|---|---|---|---|---|---|
| C Major | C | Dm | Em | F | G | Am | Bdim | B♭ |
| D♭ Major | D♭ | E♭m | Fm | G♭ | A♭ | B♭m | Cdim | B |
| D Major | D | Em | F♯m | G | A | Bm | C♯dim | C |
| E♭ Major | E♭ | Fm | Gm | A♭ | B♭ | Cm | Ddim | D♭ |
| E Major | E | F♯m | G♯m | A | B | C♯m | D♯dim | D |
| F Major | F | Gm | Am | B♭ | C | Dm | Edim | E♭ |
| F♯ Major | F♯ | G♯m | A♯m | B | C♯ | D♯m | E♯dim | E |
| G Major | G | Am | Bm | C | D | Em | F♯dim | F |
| A♭ Major | A♭ | B♭m | Cm | D♭ | E♭ | Fm | Gdim | G♭ |
| A Major | A | Bm | C♯m | D | E | F♯m | G♯dim | G |
| B♭ Major | B♭ | Cm | Dm | E♭ | F | Gm | Adim | A♭ |
| B Major | B | C♯m | D♯m | E | F♯ | G♯m | A♯dim | A |

Table 3 summarizes chords that can be chosen for a minor key. In a minor key, the following chords could be chosen: Tonic minor (i), Supertonic diminished (ii'), Mediant Major (III), Subdominant minor (iv), Dominant minor (v), Submediant Major (VI), Subtonic Major (VII) and the non-diatonic chord—the Dominant Major (V). In the key of C Minor, therefore, the following chords would be selected: C minor (i), D diminished (ii'), E-flat Major (III), F minor (iv), G minor (v), A-flat Major (VI), B-flat Major (VII), G Major (V). In the key of D Minor, the following chords would be selected: D minor (i), E diminished (ii'), F Major (III), G minor (iv), A minor (v), B-flat Major (VI), D Major (VII), A Major (V)

TABLE 3

| Key | Tonic I Minor | Super-tonic II* Diminished | Mediant III Major | Sub-dominant iv Minor | Dominant v Minor | Sub-mediant VI Major | Sub-tonic VII Major | Dominant parallel V Major |
|---|---|---|---|---|---|---|---|---|
| C Minor | Cm | Ddim | E♭ | Fm | Gm | A♭ | B♭ | G |
| D♭ Minor | C♯m | D♯dim | E | F♯m | G♯m | A | B | G♯ |
| D Minor | Dm | Edim | F | Gm | Am | B♭ | C | A |
| E♭ Minor | E♭m | Fdim | G♭ | A♭m | B♭m | C♭ | D♭ | B♭ |
| E Minor | Em | F♯dim | G | Am | Bm | C | D | B |
| F Minor | Fm | Gdim | A♭ | B♭m | Cm | D♭ | E♭ | C |
| G♭ Minor | F♯m | G♯dim | A | Bm | C♯m | D | E | C♯ |
| G Minor | Gm | Adim | B♭ | Cm | Dm | E♭ | F | D |
| A♭ Minor | G♯m | A♯dim | B | C♯m | D♯m | E | F♯ | D♯ |
| A Minor | Am | Bdim | C | Dm | Em | F | G | E |
| B♭ Minor | B♭m | Cdim | D♭ | E♭m | Fm | G♭ | Adim | F |
| B Minor | Bm | C♯dim | D | Em | F♯m | G | A | F♯ |

Figure 3:
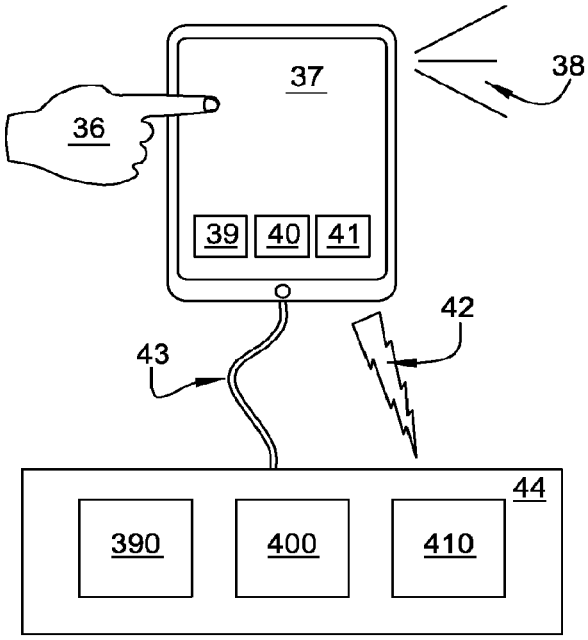
FIG. 3 depicts a schematic illustration of a musical performance and input device.

Referring to FIG. 3, a schematic illustration of a musical performance and input device 37 is shown. The device 37 can accept one or more user inputs 36 via a touch screen. The device 37 can then play one or more audible tones 38. The device 37 can include a recording unit 39, a playback unit 40, and/or an editing unit 41. The device 37 can communicatively couple via a wire 43 or via a wireless signal 42 with a second device 44. The second device 44 can include a recording unit 390, a playback unit 400, and/or an editing unit 410.

Figure 4:
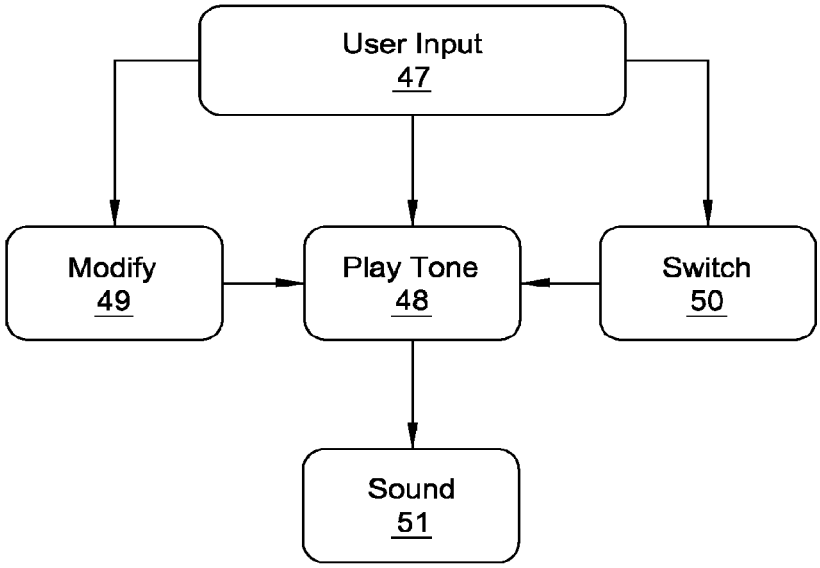
FIG. 4 depicts a schematic illustration of a musical performance method.

Referring to FIG. 4, a schematic illustration of a musical performance method is shown. A musical performance method can include accepting user inputs 47. Depending on the nature of the user input 47, the musical performance method can include audibly sounding 48 one or more tones or sounds 51. The musical performance method can also include accepting a user input 47 to modify 49 one or more tones in a set of tones; and/or accepting a user input 47 to switch 50 between multiple sets of tones. Thereafter, the musical performance method can include audibly sounding 48 one or more tones or sounds 51.

Figure 5:
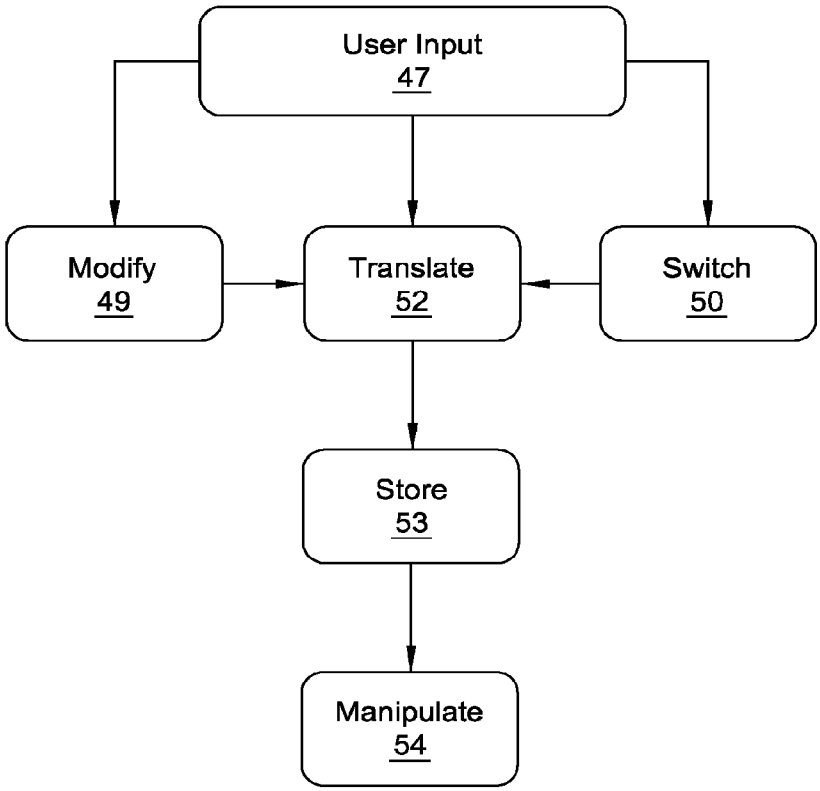
FIG. 5 depicts a schematic illustration of a musical input and manipulation method.

Referring to FIG. 5, a schematic illustration of a musical input and manipulation method is shown. A musical performance method can include accepting user inputs 47. If necessary, the musical performance method can translate 52 the user input 47 into a form that can be stored. Thereafter, the musical performance system can store 53 the user input 47. Once stored, the user input can be accessed and manipulated or edited 54. The musical performance method can also include accepting a user input 47 to modify 49 one or more tones in a set of tones; and/or accepting a user input 47 to switch 50 between multiple sets of tones. Thereafter, the musical performance method can proceed to translating 52 the user input 47, if necessary.

The technology can take the form of an entirely hardware embodiment, an entirely software embodiment or an embodiment containing both hardware and software elements. In one embodiment, the invention is implemented in software, which includes but is not limited to firmware, resident software, microcode, etc. Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid-state memory, magnetic tape, a removable computer diskette, a random access memory (RAM), a read-only memory (ROM), a rigid magnetic disk and an optical disk. Current examples of optical disks include compact disk-read only memory (CD-ROM), compact disk read/write (CD-R/W) and DVD. Both processors and program code for implementing each as aspect of the technology can be centralized and/or distributed as known to those skilled in the art.

According to another embodiment, a plurality of musical performance and/or input systems can be communicatively coupled via a wire or wirelessly. The plurality of systems can communicate information about which configurations, rigs, effects, grooves, settings, keys, and tempos are selected on any given device. Based on the communicated information, the systems can synchronize, i.e. one or more systems can adopt the configurations and/or settings of another system. This embodiment can allow a plurality of users to perform and/or record a musical performance simultaneously and in synchronicity. Each user can play the same instrument or each user can play a different instrument.

Figure 6:
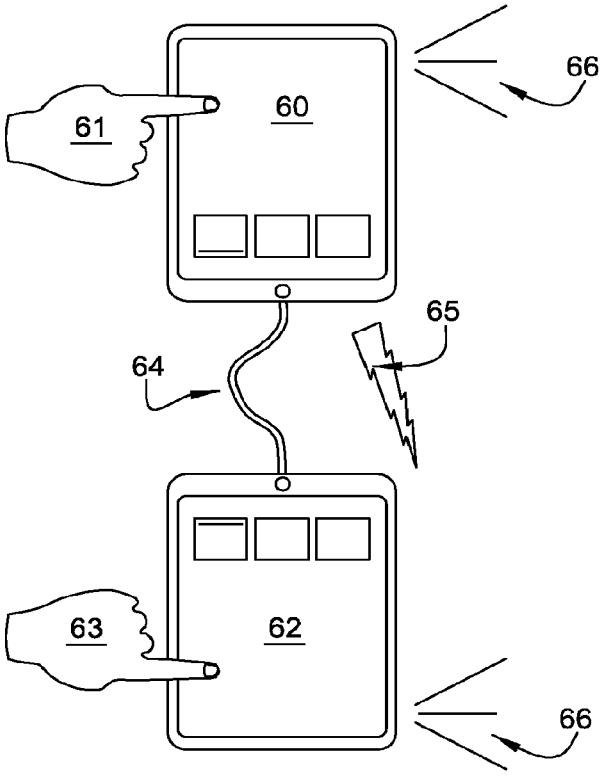
FIG. 6 depicts a schematic illustration of a plurality of communicatively coupled musical performance and/or input systems.

FIG. 6 illustrates a first system 60 played by a first user 61 communicatively coupled to a second system 62 played by a second user 63. The communicative coupling can be achieved via a wire 64 or wirelessly via a wireless signal 65. When coupled, the first system 60 and the second system 62 can produce a synchronized output 66.

The above disclosure provides examples and aspects relating to various embodiments within the scope of claims, appended hereto or later added in accordance with applicable law. However, these examples are not limiting as to how any disclosed aspect may be implemented, as those of ordinary skill can apply these disclosures to particular situations in a variety of ways.

All the features disclosed in this specification (including any accompanying claims, abstract, and drawings) can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, sixth paragraph. In particular, the use of "step of" In the claims herein is not intended to invoke the provisions of 35 U.S.C. §112, sixth paragraph.

What is claimed is:

1. A method comprising:

displaying a virtual musical instrument (VMI) on a touch-sensitive graphical user interface (GUI), wherein the VMI has one or more adjacent swipe regions associated with an assigned chord of a predefined set of chords, and wherein the VMI has one or more virtual strings crossing the one or more swipe regions, the virtual strings being associated with a note of the assigned chord;

receiving an input corresponding to a swipe gesture along a swipe region, the swipe gesture crossing at least one of the virtual strings; and playing one or more notes corresponding to the virtual strings crossed by the swipe gesture, wherein the played notes are determined by the swipe region that the swipe gesture originated in.

2. The method of claim 1 wherein the swipe regions are parallel to one another, and wherein the virtual strings are configured in a perpendicular arrangement with respect to the swipe regions.

3. The method of claim 1 wherein the predefined set of chords correspond to a musical key.

4. The method of claim 1 wherein the assigned chords and predefined set of chords are programmable.

5. The method of claim 1 wherein the played notes correspond to an audio file.

6. A computer-implemented system comprising:

one or more processors; and one or more non-transitory computer-readable storage mediums containing instructions configured to cause the one or more processors to perform operations including:

displaying a virtual musical instrument (VMI) on a touch-sensitive graphical user interface (GUI), wherein the VMI has one or more adjacent swipe regions associated with an assigned chord of a predefined set of chords, and wherein the VMI has one or more virtual strings crossing the one or more swipe regions, the virtual strings being associated with a note of the assigned chord;

receiving an input corresponding to a swipe gesture along a swipe region, the swipe gesture crossing at least one of the virtual strings; and playing one or more notes corresponding to the virtual strings crossed by the swipe gesture, wherein the played notes are determined by the swipe region that the swipe gesture originated in.

7. The system of claim 6 wherein the swipe regions are parallel to one another, and wherein the virtual strings are configured in a perpendicular arrangement with respect to the swipe regions.

8. The system of claim 6 wherein the predefined set of chords correspond to a musical key.

9. The system of claim 6 wherein the assigned chords and predefined set of chords are programmable.

10. The system of claim 6 wherein the played notes correspond to an audio file.

11. A non-transitory computer-program product tangibly embodied in a machine-readable non-transitory storage medium, including instructions configured to cause a data processing apparatus to:

display a virtual musical instrument (VMI) on a touch-sensitive graphical user interface (GUI), wherein the VMI has one or more adjacent swipe regions associated with an assigned chord of a predefined set of chords, and wherein the VMI has one or more virtual strings crossing the one or more swipe regions, the virtual strings being associated with a note of the assigned chord;

receive an input corresponding to a swipe gesture along a swipe region, the swipe gesture crossing at least one of the virtual strings; and play one or more notes corresponding to the virtual strings crossed by the swipe gesture, wherein the played notes are determined by the swipe region that the swipe gesture originated in.

12. The computer-program product of claim 11 wherein the swipe regions are parallel to one another, and wherein the virtual strings are configured in a perpendicular arrangement with respect to the swipe regions.

13. The computer-program product of claim 11 wherein the predefined set of chords correspond to a musical key.

14. The computer-program product of claim 11 wherein the assigned chords and predefined set of chords are programmable.

15. The computer-program product of claim 11 wherein the played notes correspond to an audio file.

* * * * *